US005358571A

United States Patent [19]

Villavicencio et al.

[11] Patent Number: 5,358,571

[45] Date of Patent: Oct. 25, 1994

[54] ENHANCED SUGAR RECOVERY

[76] Inventors: Eduardo J. Villavicencio; Eduardo G. Villavicencio Charpentier, both of Canada #135 Jardines Del Pedregal De, San Angel, Mexico D.F., Mexico

[21] Appl. No.: 67,591

[22] Filed: May 27, 1993

[51] Int. Cl.[5] ..... C13D 1/02; B30B 9/02; B30B 9/20

[52] U.S. Cl. ..... 127/2; 127/42; 127/43; 127/53; 100/37; 100/73; 100/121

[58] Field of Search ..... 127/42, 2, 43, 53; 100/37, 73, 121

[56] References Cited

U.S. PATENT DOCUMENTS

| | | | |
|---|---|---|---|
| 471,995 | 3/1892 | Gschwind | 127/2 |
| 480,571 | 8/1892 | Faron | 127/6 |
| 757,296 | 4/1904 | Gibbens et al. | 127/2 |
| 820,074 | 5/1906 | Spelman | 127/4 |
| 2,650,176 | 8/1953 | Horton et al. | 127/43 |
| 3,212,857 | 10/1965 | Heinrich | 127/42 |
| 3,537,142 | 7/1968 | Villavicencio | 19/26 |
| 3,695,931 | 10/1972 | Hamill | 127/4 |
| 4,378,253 | 3/1983 | Bouvet | 127/6 |
| 4,804,418 | 2/1989 | Gantier | 127/2 |
| 5,073,200 | 12/1991 | Leibig | 127/2 |
| 5,118,353 | 6/1992 | Tilby | 127/2 |
| 5,266,161 | 11/1993 | Kroeker | 127/43 |

*Primary Examiner*—Paul Lieberman
*Assistant Examiner*—Patricia L. Hailey
*Attorney, Agent, or Firm*—Michael J. McGreal

[57] ABSTRACT

Extraction processes for the recovery of sugar from sugar cane can be improved by the incorporation of a fiber depither between one or more of the extraction mills. The cane fiber from an extraction mill is fed to a fiber depither where the cane fibers are macerated to break sugar containing cells. The sugar is removed in a liquid stream and the cane fibers in a solids stream. The cane fibers are preferably fed to a subsequent extraction mill. The liquid stream is preferably flowed countercurrent to the flow of cane fiber to the first extraction mill. From the first extraction mill the liquid stream is sent to sugar recovery.

12 Claims, 3 Drawing Sheets

ENHANCED SUGAR RECOVERY

BACKGROUND OF THE INVENTION

This invention relates to processes to enhance the recovery of sugar values from sugar cane. More particularly, this invention relates to the use of a fiber depither in an extraction process for the removal of sugar values from sugar cane.

There are two different processes that have been used for recovering sugar from sugar cane. The most commonly used process is the extraction process. This process uses a tandem series of mills which through pressure removes the sugar from the sugar cane. The other process is the diffusion process which is a process that operates on diffusion principles and is used predominantly for the recovery of sugar values from sugar beets. However, there has been some adaption of diffusion techniques for recovering sugar from sugar cane and into the extraction processes that are used to remove sugar from sugar cane. In general, the incorporation of diffusion techniques into extraction processes has increased the recovery of sugar from about 94 percent to about 96 percent. These generally yield improvements over the straight extraction processes.

In usual extraction processes, the prepared cane passes to a series of mills called a tandem or milling train. These mills usually are composed of massive horizontal cylinders or rolls in groups of three, one on the top and two on the bottom in a triangle formation. The rolls are about 50–100 cm in diameter, 1–3 m long, and have grooves that are 2–5 cm wide and deep around the circumference. There may be anywhere from 3–7 of these three-roll mills in tandem. These mills, together with their associated drives and gearing, are quite massive machinery. In the usual arrangement the bottom two rolls are fixed, and the top roll is free to move vertically. The top roll is hydraulically loaded with a force equivalent of about 300 to 700 tons. The rolls turn at about 2–5 rpm, and the velocity of the cane through the rolls is about 10–25 cm/second. After passing through each mill, the fibrous residue from the cane, called bagasse, is carried to the next mill by bagasse conveyors. In order to achieve good extraction, a countercurrent system of liquid spray addition is also used. The bagasse going to the final mill in the tandem array is sprayed with water to extract whatever sucrose remains. The resultant liquid, sometimes called a juice, is then sprayed on the bagasse mat going to the next to last mill, and so on to the first mill in a countercurrent stream to the flow of bagasse. As a result this countercurrent liquid stream is getting richer in sugar content. The combination of all these liquids from all of the mills is collected, usually from the first mill, and is mixed with the liquid from the cane crusher. The cane crusher is part of the cane preparation unit where the cane is cut into segments and crushed. The result is called a mixed juice and is the material that goes forward to make sugar as it is known by the consumer.

As has been noted, diffusion processes are used primarily with sugar beets but are little used with sugar cane. The processes used with cane are mostly washing as in the extraction processes with very little true diffusion from unbroken plant cells. Since the washing is much faster, great effort is expended in preparing the cane by breaking it so thoroughly that a maximum number of the plant cells can be ruptured. However there are still many plant cells that are not ruptured. In many instances, diffusers were added to an already existing extraction mill, and in such cases usually the diffuser unit is placed after the crusher rolls. In the diffusers, the shredded cane travels countercurrent to hot water at about 75° C. In a ring diffuser the cane moves around in an annular ring. In tower diffusers, the cane moves vertically in the tower. In rotating drum diffusers, the cane travels in a spiral. The diffusion processes use much more water than the extraction processes and depend on a diffusion into and out of the plant cells. During this travel the water solubilizes more and more sugar through the cell walls. Since there is more water used the dissolved sugar stream will be more dilute than that from extraction processes and the bagasse will have a higher water content. In general, before subsequent use of the bagasse it will have to be dried by some technique, such as by pressing and using process heat.

Fiber depithers are heavy duty machines with a relatively high speed rotor surrounded by a basket cylinder that has a plurality of openings through which liquids can pass. These openings will also permit some solids to pass through but will not permit fibers to pass. The fibers move along the inner surface of the basket cylinder from the input and to the output end. In a vertical depither, which is the most common depither, this will be in a downward direction. Attached to the rotor, and which move the fibers downwardly, are a plurality of hammers and/or blades. These are arranged to feed the fiber into the depither, align the fibers on the basket cylinder wall and via a rolling action move the fibers from the input to the exit. The rotor of a depither, which supports the hammers and blades, will usually rotate at about 250–1,500 rpm. A liquid such as water can be added to the depither either at the fiber input and/or at another point in the depither, such as at a midpoint.

Fiber depithers are sized by the diameter of the basket cylinder. These are typically of about 97 cm to 254 cm, The throughput of a typical depither ranges from 70 metric tons per hour of bagasse (bone dry) to about 500 metric tons per hour. The rotor of the depither can have hammers or blades of the same type or of different types. In some depithers hammer blades are used at the input to break up fiber bundles and to orient the fibers. Blades are then used to work on the fiber bundles. At the lower end there can be fan blades to push more water from the fibers and through the basket cylinder. The particular hammers or blades used are chosen for each use. The spacing of the end of the depither hammer or blade from the wall of the basket cylinder will range from about 12.7 mm to 25.4 min.

It has now been found that the efficiency of an extraction sugar recovery process can be increased to about 99 percent through the incorporation of a fiber depither into the extraction process sequence. The fiber depither, which is a common fixture in paper mills that process bagasse into a fiber pulp for papermaking, is placed between two of the extraction mills. More than one fiber depither can be used in a tandem mill arrangement but one will usually be sufficient. The fiber is fed from an extraction mill to the depither with the fiber output from the depither flowed to a subsequent extraction mill. Liquids from the depither are usually filtered and fed to a prior extraction mill although they could be fed to a subsequent extraction mill. The depither serves to further break down and rupture the cells of the sugar cane that are holding the sugar and to separate the sugar from these cells and from the fibers. The net result is a fiber that has a significantly reduced sugar content.

This new extraction process that utilizes fiber depithers is economically advantageous for at least two reasons. In the first place, there is a greater sugar recovery. This results in the production of a greater quantity of a saleable sugar product per ton of cane processed. There is also the advantage that the bagasse fiber that is also a product of sugar cane processing will contain less residual sugar. This improves the value of the bagasse fiber for papermaking. By having a lower sugar content, there is less source material to be converted into acids during bagasse fiber storage. During bagasse fiber storage, the sugar content will ferment to acids. The resulting acids will attack the fiber with the net result of a weaker fiber that is flowed to papermaking. Consequently, the greater the sugar removal from the cane at the sugar mill, the better the paper product that is produced by the paper mill.

Essentially, any fiber depithers can be used in the present improved extraction processes. However, the preferred fiber depithers are those described in U.S. Pat. No. 3,537,142 and U.S. Pat. No. 4,641,792, which are incorporated herein by reference. These are vertical depithers. These fiber depithers are known machines and have been used in papermaking processes for at least twenty five years. However, they have not been used in the processing of sugar cane to recover sugar. Illustrative of extraction processes for recovering sugar from sugar cane are those processes that are described in U.S. Pat. Nos. 3,695,931; 4,378,253 and 5,073,200. U.S. Pat. No. 3,695,931 discloses extraction tandem mill processes which also incorporate reflux mills. The reflux mills are said to enhance the recovery of sugar. U.S. Pat. No. 4,378,253 discloses an extraction mill where the top roller in a three roller arrangement has passageways to take-up the liquids that are pressure extracted from the bagasse. This is stated to improve sugar recovery. In U.S. Pat. No. 5,073,200 there are disclosed relatively low pressure extraction mills that yet provide for good sugar recovery. All of these patents are directed to improved sugar recovery from extraction mills. However, none of these references discloses the incorporation of a fiber depither into the sugar extraction process to get an enhanced recovery of sugar of up to about 99 percent.

BRIEF SUMMARY OF THE INVENTION

It is an object of the present invention to increase the efficiency of extraction processes for the recovery of sugar from sugar cane. This and other objects are accomplished by the use of a fiber depither in the extraction process sequence. The fiber depither is placed between two stages of extraction. The sugar cane fiber from one extraction mill is fed to the input of a fiber depither. Preferably liquids are added to the fibers as they are fed to the depither to increase the moisture (water) content of the fibers to about 58 percent by weight to 92 percent by weight. The fiber then flows through the depither by the action of a plurality of hammers and/or blades. The fiber exiting from the depither is flowed to a subsequent extraction mill. The liquids from the depither are preferably flowed to a prior extraction mill as the liquid used to solubilize and to remove sugar values from the cane fibers. However these liquids could be flowed to a subsequent extraction mill or directly to sugar recovery. The liquid from the extraction mills is collected, usually at the first extraction mill after a countercurrent flow, and forwarded to sugar recovery. The fiber is collected and sent to fuel boilers and/or to papermaking.

The effectiveness of the depither in extraction processes for recovering sugar can be enhanced if at about a mid-point of the depither a liquid such as water is added. In this way as the blades and/or hammers macerate the fiber and open the sugar containing cells the sugar is rapidly solubilized and separated from the fibers and cell materials. This added liquid combines with other liquids separated from the fibers in the depither. As noted this liquid preferably goes to a prior extraction mill but can go to a subsequent extraction mill or to sugar recovery.

The liquid that is added to the fibers that are being inputted into the depither is preferably the liquid that is extracted from the fiber in an extraction mill subsequent to the depither. This is then flowed from the depither with the other liquids preferably in a countercurrent fashion to the first extraction mill.

DETAILED DESCRIPTION OF THE INVENTION

Figure 1:
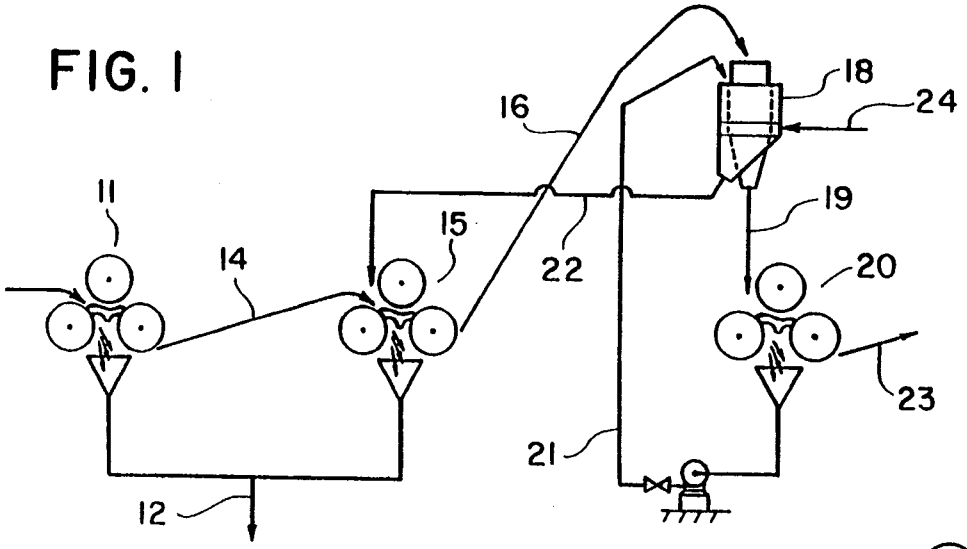
FIG. 1 shows a diagram of a system having three extraction mills and one fiber depither.

The present invention will now be described in detail with reference to the drawings. The drawings describe some of the more useful different arrangements of extraction mills and fiber depithers that can be used to get an enhanced extraction of sugar from sugar cane. More than two fiber depithers could be used but then there is a loss of overall process efficiency. The arrangements that are described in the drawings provide for a high process efficiency. In a preferred mode, it is useful to have an arrangement of four extraction mills and one fiber depither. That fiber depither will be between the third and fourth extraction mills.

The extraction mills can be of any standard type. Useful extraction mills are those known as the grinding line equipped with four "Tandem" mills. These extraction mills have three rolls. The lower stationary mills are 2.5 meters in length and 90 centimeters in diameter. The third and upper roll is of the same dimension. The surface of the rolls has a fluted surface with grooves of 2 to 5 cm wide and deep around the circumference. The top roll can have a bearing pressure of from about 300 metric tons to 700 metric tons onto the lower rolls, and preferably about 500 metric tons to 700 metric tons. The rolls are rotated at a speed of 3 rpm to 4 rpm, and preferably about 3.8 rpm. Cane fiber is processed through the rolls at about 150 to 500 tons per hour.

The fiber depithers are sized to accept cane fiber at the same rate that it is being processed by the extraction mills, The fiber depithers have a throughput at from about 70 to 500 metric tons per hour. A useful fiber depither is a vertical depither and in particular the Peadco depither. These depithers are comprised mainly of a rotor which carries a plurality of hammers, knife blades and fan blades and surrounding basket which has a large number of small passages. Typically, these passages are about 2 to 9 mm in diameter. In most embodiments, about 75 to 95 percent of the basket surface contains these passages. The cane fiber is fed into the fiber depither using a pin feeder. The preferred fiber depithers are those described in U.S. Pat. No. 4,641,792.

The overall diameter of the basket is about 96.5 cm to 254 cm, and preferably 117 cm. The rotor is held in place by upper and lower bearings. The rotor rotates at about 250 rpm to 1,500 rpm and is powered by an electric motor having about 300 horsepower. The electric motor is preferably connected to the rotor by means of belts and pulleys. The rotor will contain about 24 to 48 hammers, knife blades and fan blades. The top 20 percent will usually be hammer blades and fan blades, the next 30 percent will be knife blades and the remaining will be fan blades. The hammer blades will be located at the fiber input followed by fan blades, the knife blades in the midsection and the fan blades in the lower section. The fibers will flow downwardly and exit from the bottom of the depither. Liquids and particulate solids pass through the basket and are collected in a separate stream. This separate stream is filtered and used in the present process as a cane fiber wash stream.

The fiber depither will preferably have a countercurrent liquid flow. Fresh wash liquid, usually water at 30% of the sugar cane weight, is injected into the lowermost section with the liquid stream exiting from the lowermost section being injected into the middle section. This liquid which contains sugar exits the middle section and is injected into the uppermost section. This liquid exits the uppermost section, is filtered, and is flowed to the prior extraction mill and used as the wash water in that extraction mill.

The depither will have separate chambers built into the screen to collect the liquids from each section. These liquids can be used directly for countercurrent flow in the depither via suitable pumps or can be flowed to reservoirs and prepared from the reservoirs for use. Regardless of the flow scheme used, the objective is to have a countercurrent flow of liquids in the depither.

In FIG. 1, there is described a three extraction mill and one depither system. The cane is prepared before being flowed to the first extraction mill. Preparation usually consists of cutting the cane to a given length and washing the cane. The cane is then put onto tables for feeding to the extraction mills. In FIG. 1 there is shown the feeding of the cane to the first extraction mill 11, the liquids extracted from the cane fiber are collected at 12 and the fiber 14 passes to the second extraction mill 15. The liquids from this extraction mill are likewise collected at 12 with the fiber 16 passing to depither 18. The fiber 19 exits the depither and flows to extraction mill 20. The liquids 21 extracted in this last extraction mill are flowed to the fiber input to the depither to wet the fiber. The liquids 22 from the fiber depither are flowed to the prior extraction mill 15. A cane fiber 23 flow from the third extraction mill. Fresh liquid is provided to the depither at 24.

Figure 2:
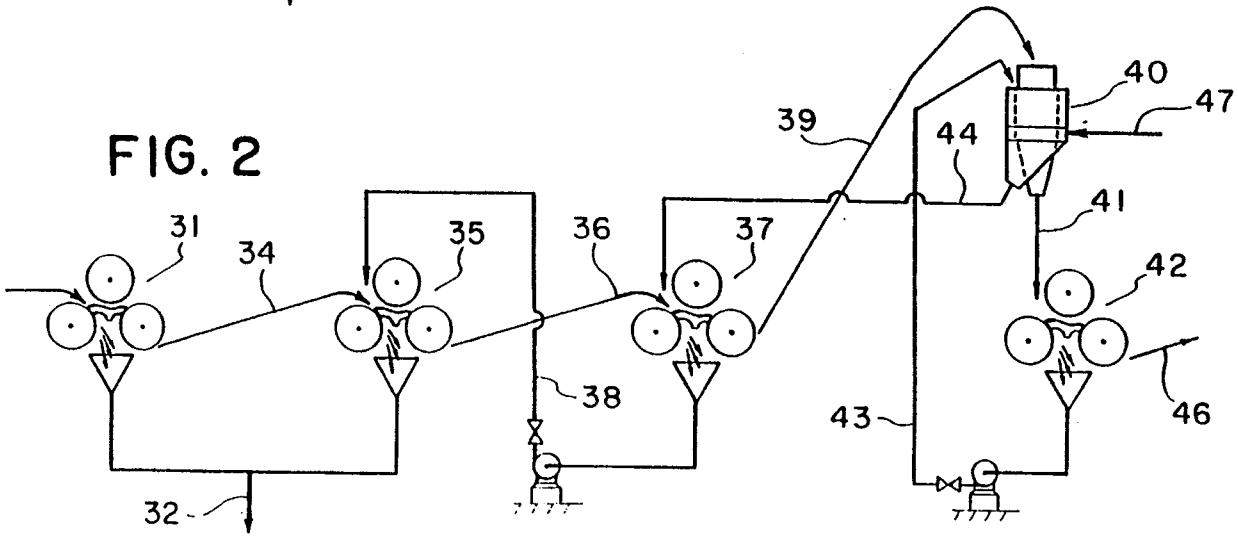
FIG. 2 shows a diagram of a system having four extraction mills and one fiber depither.

In FIG. 2, there is shown the use of four extraction mills and one depither. The cane is prepared as described above. The cane fiber is fed into extraction mill 31. The liquids from the cane fiber are collected at 32 and the fiber 34 passes to the second extraction mill 35. The liquids from the first extraction mill are collected at 32. The fiber 36 from the second extraction mill is flowed to third extraction mill 37 where it again undergoes processing. The liquid stream 38 is flowed to the second extraction mill as the wash water. The fiber 39 is flowed to depither 40. The fiber 41 exits the depither and flows to fourth extraction mill 42. The liquid stream 43 from the depither is flowed to the third extraction mill as the wash water, The liquid stream 44 from the fourth extraction mill is flowed to the depither input to further wet the input fiber. A cane fiber 46 exits the fourth extraction mill. A fresh liquid stream 47 is flowed to the depither.

Figure 3:
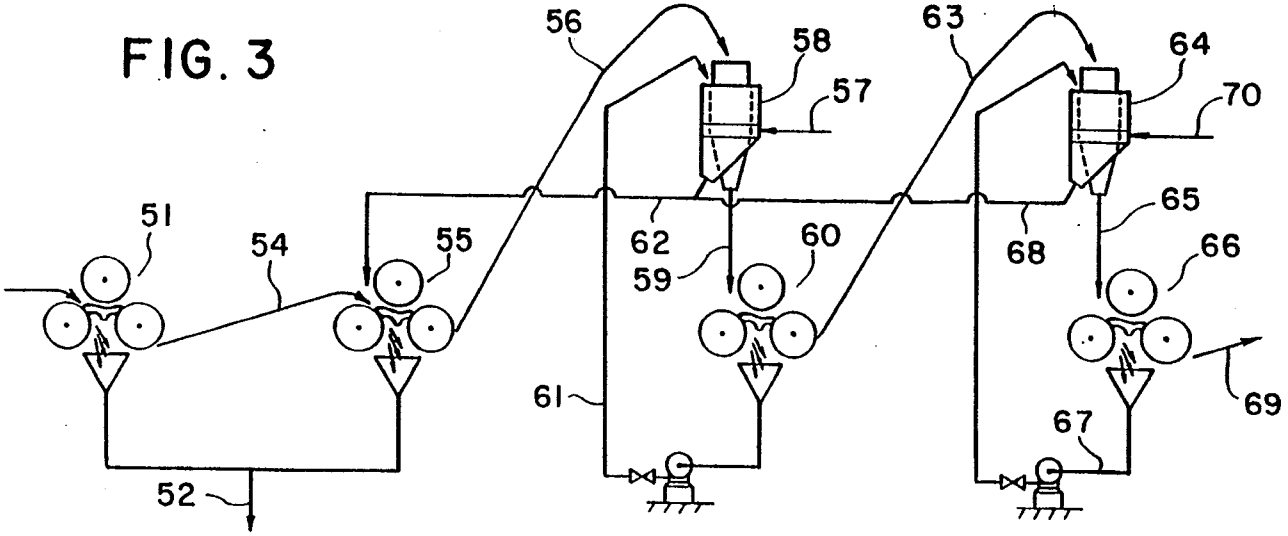
FIG. 3 shows a diagram of a system having four extraction mills and two fiber depithers.

FIG. 3 shows a system that is comprised of four extraction mills and two depithers. The fiber is prepared as described for FIG. 1 and flowed to extraction mill 51. The processed fiber 54 exits the first extraction mill and is fed to second extraction mill 55. The liquid from this second extraction mill is collected at 52 with the cane fiber 56 passing to depither 58. The cane fiber 59 exits this first depither and flows to third extraction mill 60. The liquid 61 from this extraction mill flows to the fiber input to depither 58. The liquid stream 62 from this depither flows to the fiber input of the second extraction mill. A fiber 63 exits this extraction mill 60 and flows to second depither 64. A cane fiber 65 exits this depither and passes to extraction mill 66. A cane fiber 69 exits extraction mill 66, with a liquid stream 67 flowing to wet the input fiber to depither 64. A liquid stream 68 from depither 64 flows to the second extraction mill. Fresh liquid 70 is flowed to depither 64.

Figure 4:
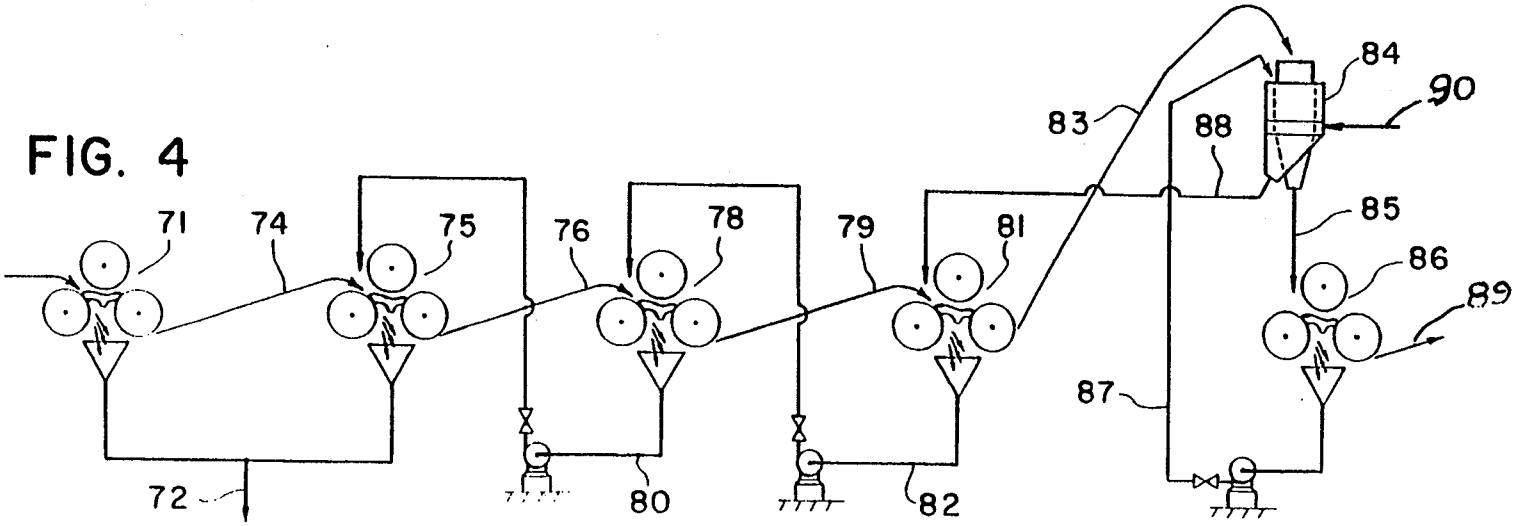
FIG. 4 shows a diagram of a system having five extraction mills and one fiber depither.

In FIG. 4 there is shown the embodiment where there are five extraction mills and one depither. The cane fiber is fed into first extraction mill 71 with a fiber stream 74 exiting and going to second extraction mill 75. The liquids 72 from the first extraction mill is passed to sugar recovery. The fiber 76 from the second extraction mill goes to third extraction mill 78. The fiber 79 exits this extraction mill and passes to a fourth extraction mill 81. The liquid stream 80 from the third extraction mill flows to the input to the second extraction mill and wets the cane fiber going into this mill. The cane fiber 83 from the fourth extraction mill passes to a fiber depither 84 while the liquid stream 82 is flowed to wet the fiber going into the third extraction mill. The fiber 85 from the fiber depither flows into the fifth extraction mill 86. A liquid stream 87 from this fifth extraction mill is flowed to wet the cane fibers entering the depither. Fresh liquid, usually water, is also flowed into the depither at 90. Liquids 88 exit the depither and are flowed to wet the fiber entering the fourth extraction mill. A cane fiber 89 exits the fifth extraction mill and flows to storage or papermaking or is used to fuel boilers.

Figure 5:
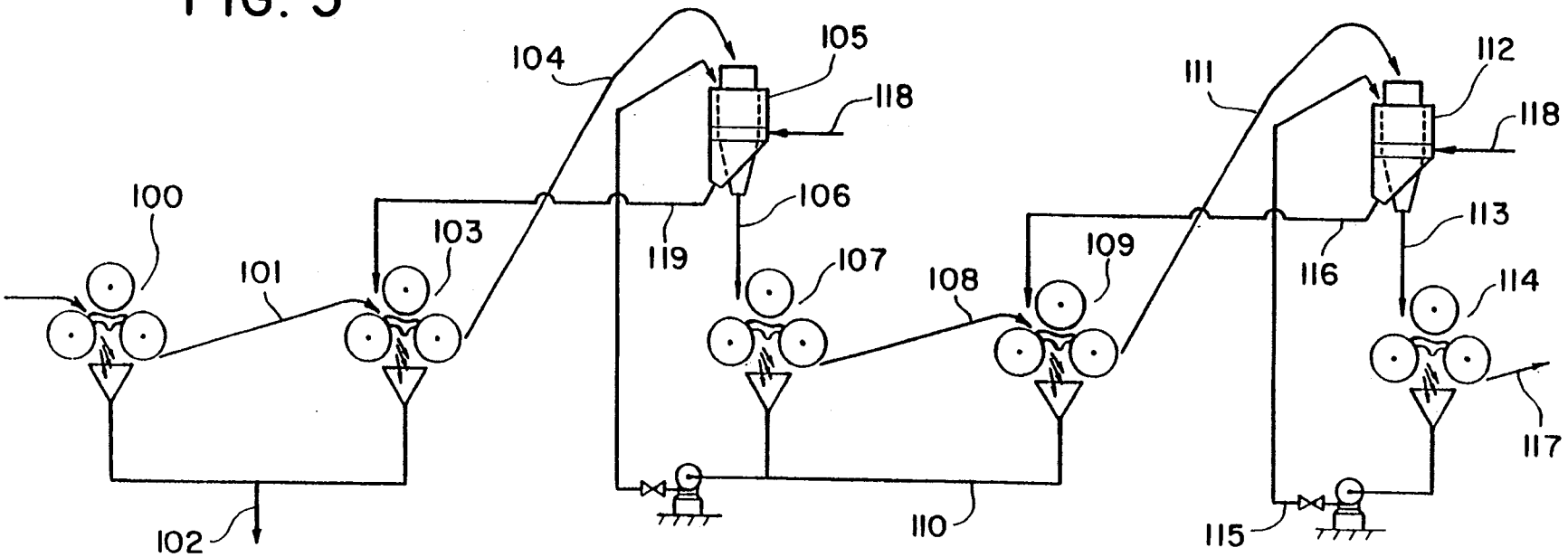
FIG. 5 shows a diagram of a system having five extraction mills and two fiber depithers.

In FIG. 5 there is shown an arrangement of five extraction mills and two depithers. There is a depither between the second and third extraction mills and the fourth and fifth extraction mills. A fiber is flowed into extraction mill 100 with a fiber 101 exiting this extraction mill and passing to a second extraction mill 103. The fiber 104 passes from this extraction mill to fiber depither 105 while a liquid stream 102 which is comprised of liquids from the first and second extraction mills is flowed to sugar recovery. A fiber 106 exits the depither and flows to third extraction mill 107. A liquid stream 119 from the depither is flowed to wet the fiber entering the second extraction mill. The fiber 108 leaves the third extraction mill and flows to fourth extraction mill 109. A cane fiber stream 111 from this mill is flowed to the second depither 112 while a liquid stream which is the aggregate of the liquids from the third and fourth extraction mills is flowed to wet the fiber entering into the first depither 105. The fiber 113 from the second depither is flowed into extraction mill 114 with a fiber 117 exiting this extraction mill. A liquid stream 115 is flowed to wet the cane fiber entering the second depither. Fresh liquids 118 such as water can be added to each depither.

The cane fibers are transported from extraction mill to extraction mill using standard conveyors. Liquid flow is through piping.

This system and the related processes can be modified in various ways but yet be within the present invention. The use of one or more fiber depithers between the extraction mills of an extraction sugar recovery process adopts the essence of the present system and processes.

The present processes are conducted at room temperature. However, heated liquid streams can be used if desired.

EXAMPLE

This is an example of the present system and process using the equipment layout of FIG. 2. There will be four extraction mills and one depither.

100 metric tons per hour of cane fiber is fed to extraction mill 31. There is recovered from this extraction mill 58.16 tons of liquid (water) which has the composition of 11.165 tons of sugar (19.2 percent sugar) while the fiber is conveyed to extraction mill 35. The cane fiber flows into this second extraction mill at 41.24 metric tons per hour and is wetted by a water stream containing 35.60 tons total with 2.651 tons of sugar (7.5 percent sugar) and flowed from the third extraction mill. The liquids from the second extraction mill 32 which contain 4.645 tons of sugar are flowed to sugar recovery along with the liquids from the first extraction mill, The cane fiber from the second extraction mill is flowed to a third extraction mill at the rate of 37.60 metric tons per hour, As noted, the liquids from this extraction mill are flowed to the fiber input to the second extraction mill. The fiber from the third extraction mill is fed to the depither at the rate of 34.48 metric tons per hour. The fiber is depithed and counter current washed with water and passes to the fourth extraction mill. Upon exiting the fourth extraction mill the fiber goes to storage for papermaking or to fuel boilers. A liquid stream from the depither which contains 1.375 ton of sugar is filtered and flowed to wet the fiber entering the third extraction mill. The liquids from the fourth extraction mill which have the composition of 0.239 ton of sugar is flowed to wet the input fibers to the depither. Fresh water is fed to the depither at 47 at the rate of 30,000 liters per hour.

The liquids that are recovered are flowed to sugar recovery. The sugar in this stream is comprised of 15.81 percent of the input cane fiber. The sugar recovery is in excess of 98 percent of the sugar in the input cane fiber.

What is claimed is:

1. An extraction process for removing sugar from cane comprising feeding a prepared sugar cane containing cane fibers to a plurality of extraction mills located in series, mascerating the cane fibers in each extraction mill to rupture cells, applying to at least a first extraction mill a first liquid in an amount effective to solubilize sugar from the cane fibers, feeding the cane fibers to a fiber depither along with a second liquid in an amount effective to solubilize sugar, wherein said depither is located between at least two of said extraction mills, depithing said cane fibers, and flowing said depithed cane fibers to at least one further extraction mill.

2. An extraction process as in claim 1 wherein liquids are removed from the cane fibers in said further extraction mill and are added to the cane fibers in said depither.

3. An extraction process as in claim 2 wherein said liquid removed from the cane fibers in said further extraction mill are added at the input of said depither to said cane fibers and adding a liquid effective to solubilize sugar values at an intermediate section in said depither.

4. An extraction process as in claim 1 wherein there are at least three extraction mills, said depither being located between the last extraction mill and the prior extraction mill, the cane fiber exiting from said prior extraction mill being flowed to the input of said depither, liquids removed from the last extraction mill being added to said fibers being input into said depither, the liquid removed from said cane fiber in said depither being flowed to the input cane fiber to said prior extraction mill and the liquid removed from said prior extraction mill being flowed to a further prior extraction mill.

5. An extraction process as in claim 4 wherein the liquid extracted from said fiber in said prior extraction mill is flowed to sugar recovery.

6. An extraction process as in claim 5 wherein the liquid extracted from said fiber in said further prior extraction mill is flowed to sugar recovery along with the extracted liquids from said prior extraction mill.

7. An extraction process as in claim 1 wherein a fluid effective to solubilize sugar values from cane fibers is added to said depither at an intermediate point thereof.

8. An extraction process as in claim 1 wherein said depither has an input section, an intermediate section and an output section, said cane fiber (i) being fed into said input section and oriented within said depither, (ii) flowing in said depither to said intermediate section and being macerated therein, and (iii) flowing to an exit section and being defluidized therein.

9. An extraction process as in claim 8 wherein a fluid effective to extract sugar from cane fibers is applied to said cane fibers in the intermediate section of said depither.

10. An extraction process a in claim 9 wherein liquids removed from the cane fibers in said further extraction mill are added to the cane fibers flowed into said depither.

11. An extraction process as in claim 1 wherein there are at least four extraction mills, said depither being located between a third and a fourth extraction mill, the cane fiber exiting from said third extraction mill being flowed to the input of said depither, liquids removed from the fourth extraction mill being added to said fibers being input into said depither, the liquid removed from said cane fiber in said depither being flowed to the input cane fiber to said third extraction mill and the liquid removed from said third extraction mill being flowed to the input cane fiber into a second extraction mill.

12. An extraction process as in claim 11 wherein there is an additional depither located between said second and third extraction mills, the cane fiber exiting from said second extraction mill being flowed to the cane fiber input to said additional depither and liquid removed from said third extraction mill being added to said cane fiber being input into said additional depither, the cane fiber exiting from said additional depither being flowed to the input cane fiber to said third extraction mill and the liquid being removed from the cane fiber in said additional depither being flowed to the input cane fiber to said second extraction mill.

* * * * *